US005488360A

United States Patent [19]

Ray

[11] Patent Number: 5,488,360

[45] Date of Patent: Jan. 30, 1996

[54] VEHICLE DETECTION AND IDENTIFICATION SYSTEM

[76] Inventor: Jimmy C. Ray, 3355 Juanita, Denison, Tex. 75020

[21] Appl. No.: 298,218

[22] Filed: Aug. 29, 1994

[51] Int. Cl.[6] ..... G08G 1/01

[52] U.S. Cl. ..... 340/933; 340/928; 235/380

[58] Field of Search ..... 340/928, 933; 235/380, 384; 379/59, 60

[56] References Cited

U.S. PATENT DOCUMENTS 5,086,389 2/1992 Hassett et al. ..... 364/401

5,325,418 6/1994 McGregor et al. ..... 379/59

*Primary Examiner*—John K. Peng

*Assistant Examiner*—Daryl C. Pope

*Attorney, Agent, or Firm*—Jerry C. Ray

[57] ABSTRACT

At a restricted-access facility such as a toll booth, queries are transmitted through an antenna having a restricted zone of transmission and reception. Cellular telephone stations aboard vehicles within this zone of reception respond to the query by transmitting an electronic identification number, which is received by the same or another antenna. The identification number is then encoded in binary format and transmitted by a transceiver connected to the antenna to a computer controller, where the identification number is compared to a list of valid user identification numbers. If the received identification number is found to be valid, the computer controller transmits a "Go" command to the traffic control equipment of the restricted-access facility.

1 Claim, 4 Drawing Sheets

VEHICLE DETECTION AND IDENTIFICATION SYSTEM

CROSS REFERENCE TO RELATED APPLICATIONS

None; Applicant has filed, however, Disclosure Document No. 357282, dated Jul. 5, 1994, which is related to this application; therefore it is requested by separate paper that said Disclosure Document be retained and acknowledgement thereof made by the Examiner.

BACKGROUND OF THE INVENTION

1. Field of the Invention

This invention relates to method and apparatus for automatically detecting and identifying vehicles equipped with cellular telephones, and more specifically to using such identification to automatically control entry to such facilities as toll booths and limited-access garages. Fees for such use are billed to the user by a computer controller. Billing capabilities may also be extended to purchases of gasoline, car washes, parking lots, etc.

2. Description of the Related Art

Several methods of automating toll-collecting have been developed. One method used in Dallas, Tex. is known as the Toll-Tag system, and includes a bar code displayed in a window of the vehicle which is read by a scanner as the vehicle passes through a special toll booth. Of the patents known to applicant, including those listed below, Carroll discloses a system using infrared light transmission. Patents by Hassett et al. disclose an in-vehicle toll processor which keeps an accounting of the amount of toll fees accumulated. Swett discloses a system using light beams to alert equipment in the toll booth that a vehicle is approaching.

All the systems described above require some type of special equipment aboard the vehicle either to identify the vehicle or to communicate with the equipment in the toll booth. Billing for usage is a separate function; some of the systems described require payment in advance of a lump sum, which is then debited with each toll-booth use.

A need exists, therefore, for an automated toll-paying system which makes use of existing equipment in the vehicle, e.g., a cellular telephone. With such a system, billing could be automated with bills mailed to the user as are other utility bills. U.S. Patents of which Applicant is aware are listed below:

| U.S. Pat. No. | Issue Date | Patentee |
|---|---|---|
| 4,398,172 | Aug. 9, 1983 | Carroll et al. |
| 5,086,389 | Feb. 4, 1992 | Hassett et al. |
| 5,101,200 | Mar. 31, 1992 | Swett |
| 5,144,553 | Sep. 1, 1992 | Hassett et al. |
| 5,253,162 | Oct. 12, 1993 | Hassett et al |

SUMMARY OF THE INVENTION:

Progressive Contribution to the Art

This invention is described primarily in terms of toll-road booths, but it is understood that the same technology will apply to any limited-access or controlled-access facilities such as parking garages, gated-entry communities, etc. The names Toll-Go and Toll-Go system are used herein to designate the identification system or components thereof.

The invention comprises an apparatus and method for automatically detecting and identifying vehicles entering a toll-road booth or some other restricted-access facility. The apparatus includes an existing cellular telephone associated with a vehicle, and a transmit-receive antenna mounted on or near a toll booth. The toll booth antenna has a narrow zone of reception, restricted to a small area of a traffic lane adjacent the entry to the toll booth. A query transmitted by the antenna triggers a response from the vehicle's cellular telephone. An electronic identification number from the telephone is received by the toll-booth antenna, transmitted to a computer controller which determines whether the number is a valid user number. If the number is valid, the computer controller transmits a "Go" command to the toll booth traffic signal; otherwise the traffic signal remains in a stop condition until a toll is paid. The computer controller initiates billing functions, resulting in a statement being mailed to the user.

Objects of this Invention

A primary object of this invention is to provide a method and structure for automatically identifying vehicles equipped with cellular telephones, and controlling the access of such vehicles to limited-access facilities such as toll roads, parking garages, security facilities, etc.

Another object of this invention is to provide a method by which fees for access to restricted areas are billed to the user's telephone number as pan of a cellular telephone bill, or as a separate billing. The billing will be like that of any other utility, based on usage.

Another object is to provide a system to accomplish the above with no action required by the user, or with minimal action required under certain circumstances.

Another object is to provide a system with nation-wide coverage, whereby a subscriber may use toll-road facilities in other cities or states, with such usage being billed to his home address.

Further objects are to achieve the above with devices that are sturdy, compact, durable, lightweight, safe, versatile, and reliable, yet inexpensive and easy to manufacture, install, operate, and maintain.

Other objects are to achieve the above with a method that is rapid, versatile, and efficient, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

CATALOG OF THE ELEMENTS

As an aid to correlating the elements of the invention to the exemplary drawings, the following catalog is provided:

10 Toll Booth
12 Antenna
14 Zone of reception
16 Vehicle Identification Zone
18 Vehicle
20 Transceiver
22 Computer Controller
24 Communications link
30 Traffic Signal

DESCRIPTION OF THE PREFERRED EMBODIMENTS

According to the invention, a vehicle is identified by an identification number which is transmitted by a cellular telephone aboard the vehicle. The identification number may be an Electronic Serial Number (ESN), or a Mobile Identification Number (MID). ESNs are assigned to a particular mobile telephone by the manufacturer of the telephone, and is transmitted by the telephone as part of a standard format promulgated by the Cellular Telephone Industries Association. MIDs are identification numbers assigned to a telephone by a telephone operating company, and are assigned by a block of such numbers allocated to the operating company for its use. Some telephone companies use both ESNs and MIDs to identify and track cellular telephone stations through their system.

The terms "ESN" and "electronic identification number" are used herein to mean any identification number transmitted by a cellular telephone station, including electronic serial numbers and mobile identification numbers. "ESN" and "electronic identification number" also specifically include other information such as vehicle instrument readings, telephone numbers, street addresses or block numbers, etc., which is transmitted in response to a page command. ESNs are primarily for customer identification to a telephone company, and are the means by which a mobile station registers with different cells as it moves through a system. ESNs are also used to determine whether a request for telephone service by a mobile unit is valid, and for billing purposes. The ESN is transmitted responsive to a page command received by the cellular telephone equipment aboard the vehicle.

Figure 1:
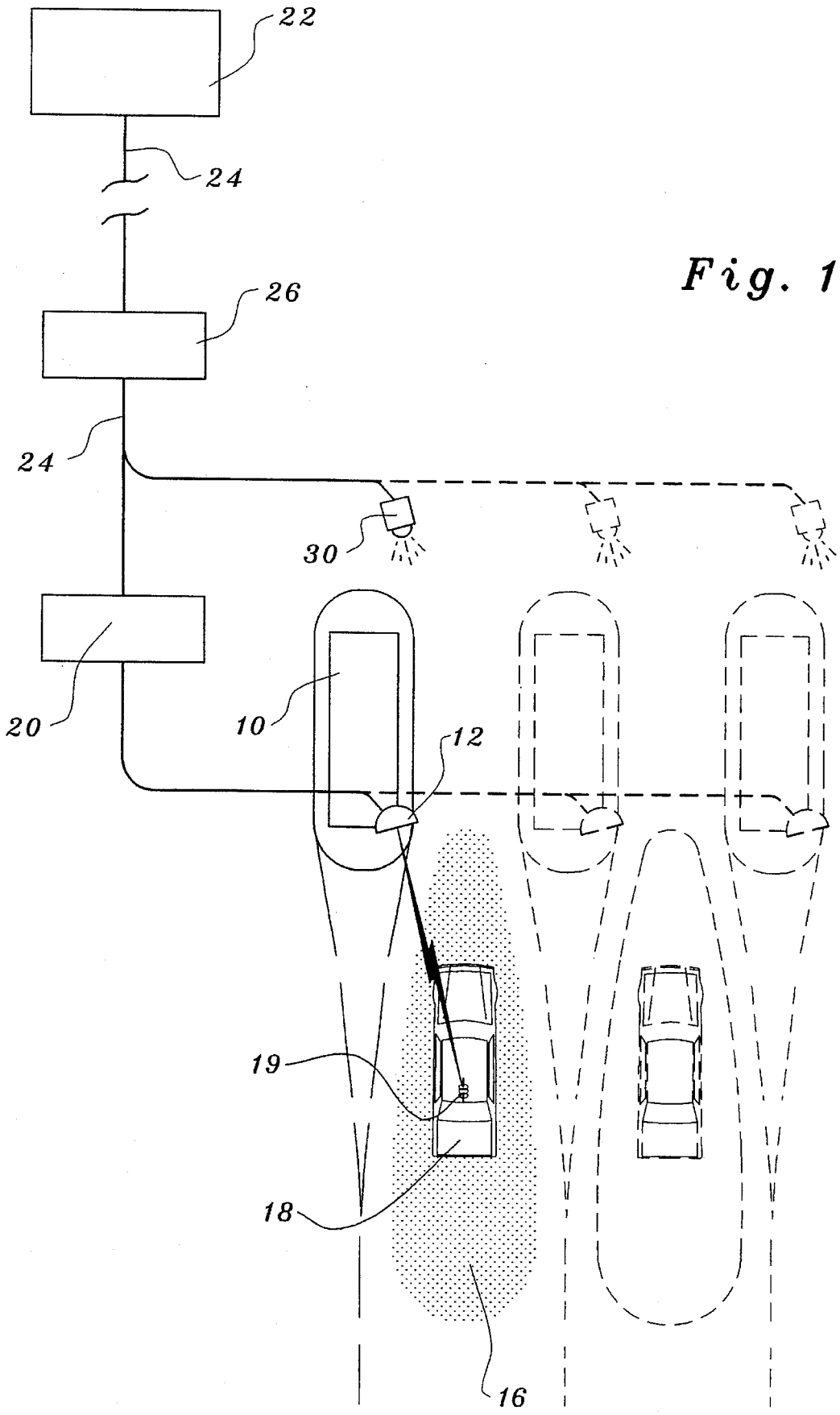
FIG. 1 is a plan view of the Toll-Go equipment associated with a toll plaza.

Referring to FIG. 1, each toll booth 10 on a toll plaza is equipped with a transmit/receive antenna 12 having a narrow zone of reception 14. The antenna 12 will transmit to or receive from a generally cone-shaped zone which may be either circular or oval in cross-section. This narrow zone of reception 14 is further limited by mounting the antennae on the upper structure of the toll booth 10, so that each antenna 12 is aimed downward toward the roadway. Thus the three-dimensional space from which any one antenna can receive or transmit a signal is limited by the directionality of the antenna and by the downward orientation of the antenna.

Figure 2:
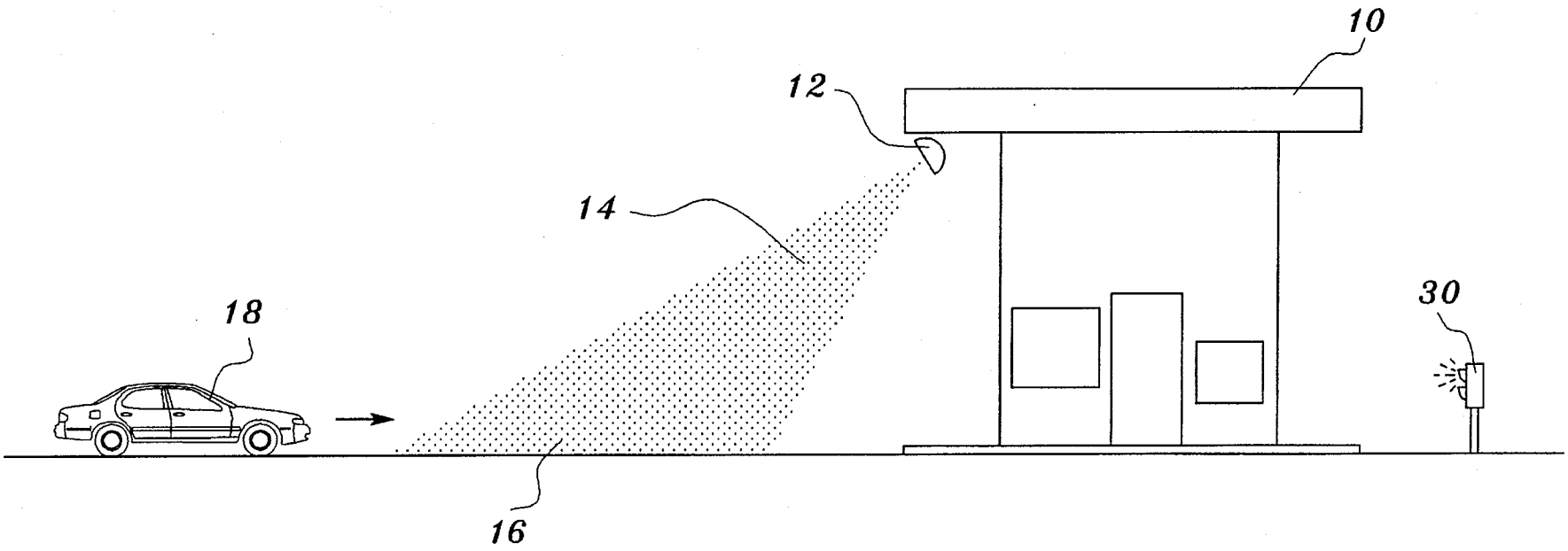
FIG. 2 is a side elevation of a toll booth with its antenna, and a vehicle about to enter the vehicle identification zone.

FIG. 2 illustrates that the downward orientation of the antenna 12 is not necessarily vertical; in the preferred embodiment the antennae are aimed at an angle toward the oncoming traffic such as vehicle 18, so the identification system operates while the vehicle is within an oval-shaped, elongated vehicle identification zone 16. The long axis of the oval is parallel to the lane of traffic. The vehicle identification zone 16 is a portion of the zone of reception 14. The vehicle identification zone may be thought of as the lower portion of the zone of reception, i.e., the part of the zone of reception adjacent the pavement which a vehicle 18 would occupy.

At 15 miles per hour, a vehicle is moving about 22 feet per second, and at 30 mph about 44 feet per second. It is contemplated that the long dimension (parallel to the direction of vehicle travel) of the vehicle identification zone 16 is about 25 feet. (See FIGS. 1 and 2.) Slow-moving vehicles will thus occupy the zone for one second or more, and more rapidly moving vehicles will be within the zone for several tenths of a second. In the Toll-Go system, the process of identifying a vehicle, checking the ESN, and subsequently transmitting a command to a traffic signal requires one-tenth second or less.

Figure 4:
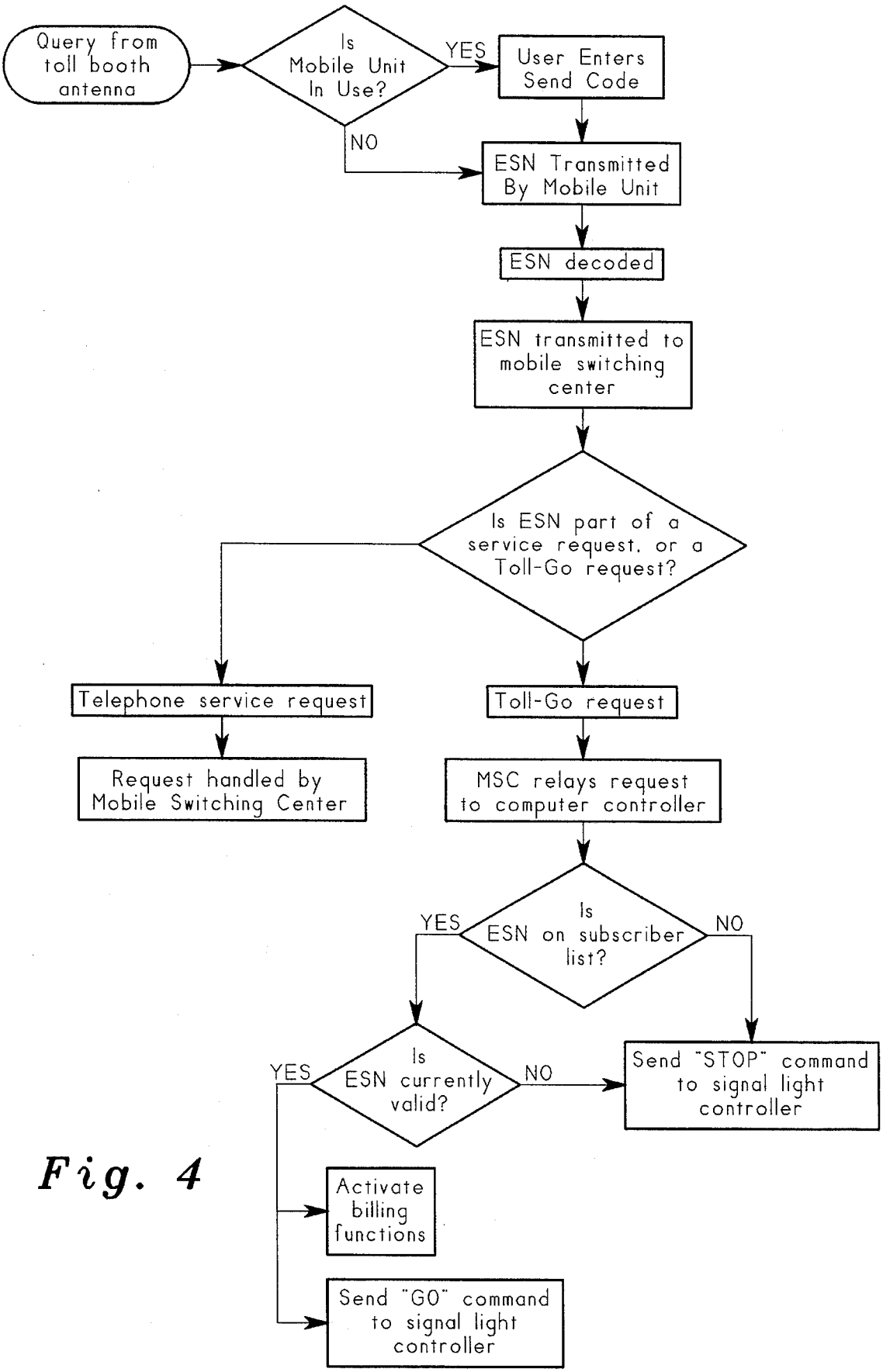
FIG. 4 is a sequence chart of operations performed by the system.

The cellular telephone equipment aboard vehicle 18 must of course be in a "power on" mode for the system to operate. Referring to FIG. 1 and to FIG. 4: as a vehicle 18 nears a toll booth 10, it enters the vehicle identification zone 16. Within the vehicle identification zone, the cellular telephone antenna 19 aboard the vehicle will receive a page command (also referred to herein as a query) from the transmit/receive antenna 12 for that particular booth. The pages or queries are transmitted at brief intervals (i.e., several times each second) by the antenna 12. Responsive to the query, the mobile station will transmit its ESN, which is received by the antenna 12 and the associated transceiver. Where the user is talking on the cellular telephone as the vehicle enters the vehicle identification zone, the mobile station will not respond to a query by the Toll-Go system. In this in-use mode, the mobile station user must enter a "send code" to cause the mobile station to transmit its ESN. The code, entered via the handset keypad, may consist of only one digit; if more security is preferred the code may be more complex and comprise two or more digits. Each mobile station can be programmed for a standard code, or for a unique code number to enhance security.

In an alternate embodiment, the Toll-Go system is passive, and sends no queries to mobile stations. Instead the system depends on an active user to send an ESN each time the vehicle enters a toll booth whether the mobile station is in use or not. The code is entered via the keypad as described in the preceding paragraph. This latter embodiment, where the Toll-Go system is passive, has the advantage that active participation by the user will lessen the frequency of failures due to the mobile station being turned off.

In another embodiment, the page or query may be transmitted by an antenna having a broader zone of reception. In this embodiment the Toll-Go system is used for vehicle identification only, such as to identify trucks crossing a state line. In this application, the transmitting antenna would have a vehicle identification zone which covered all the lanes of a roadway, so that cellular telephone equipped trucks would respond with an ESN. The ESNs are then received by a receive antenna associated with a single lane, or by an antenna with a zone of reception covering all the lanes. The ESNs are automatically recorded and stored, or transmitted to a remote location to be processed as necessary for the particular purpose to be served.

Figure 3:
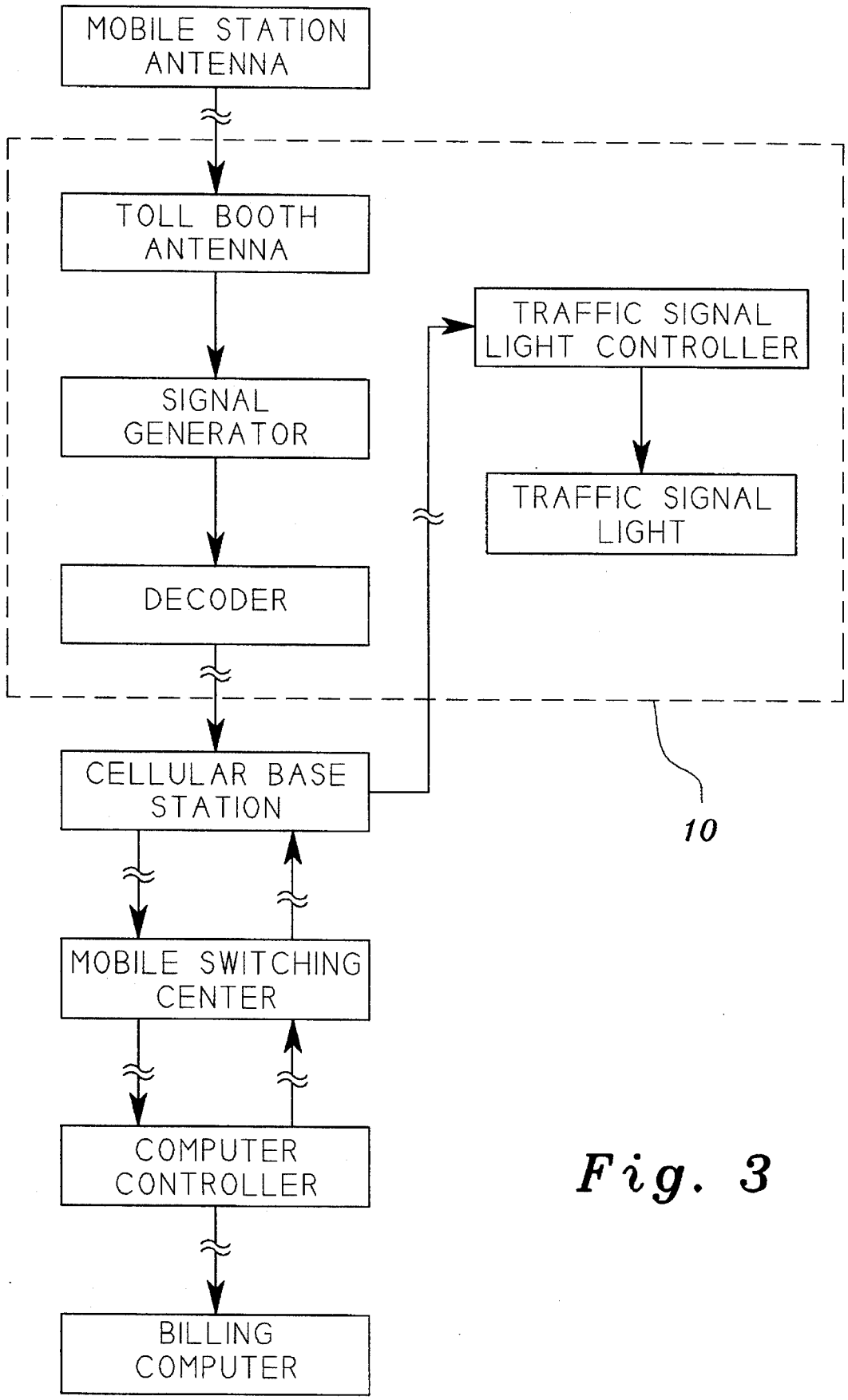
FIG. 3 is a block diagram of the signal path between various components of the system.

In either of the first two modes described above, the operation of the Toll-Go system is the same after the ESN is received. Associated with the antenna 12 is a transceiver 26 with encoder/decoder circuitry. The receiver portion of the transceiver operates in conjunction with the antenna to boost the strength of the received signal; then the encoder/decoder converts the received ESN into a binary language for transmission to a computer controller 22 for validation. In the preferred embodiment, the computer controller 22 is associated with a cellular telephone system, i.e., it is the computer which handles switching, routing, and other decisions related to cellular telephone service. Transmission of the ESN to the computer controller 22 is via communications link 24. En route to computer controller 22, communications link 24 will generally be routed through cellular base station 26. Communications link 24 is any suitable type of electronic or optical circuit. FIG. 3 illustrates the signal path between the various elements of the invention, from the mobile telephone antenna to the computer controller, and back from the computer controller to the toll-booth traffic signal.

In the validation process by the computer controller 22, the received ESN is compared to a list of valid user ESNs. The received ESN is found to be valid when it matches a number on the list of valid numbers, and invalid if it does not.

Occasionally an equipment or transmission problem may cause the computer controller 22 to receive a garbled ESN, in which case it is desirable to have some degree of redundancy built into the system. Where the ESN does not match one on the list of valid ESNs, the computer controller 22 may command the transceiver 20 to repeat its query, and trigger another transmission of the ESN by the mobile station. The "new" ESN is then checked against the list as before, so that the entire process from query to validation is repeated.

In an alternate method, which does not require the time needed for another query, the receiving equipment 20 at the toll booth 10 has a short-term memory in which it stores two or more transmissions of an ESN. In this embodiment, the mobile station sends its ESN at least twice in response to a query or to a user command. At the request for a repeat by the computer controller, the equipment at the toll booth transmits the same ESN from its short-term memory, which is then checked as before.

If the ESN is determined by the computer controller 22 to be valid, the computer sends a command via the communications link 24 to cause the traffic signal 30 at the toll booth 10 to change to green and/or to give other appropriate "Go" signals. If the ESN is determined to be invalid, the computer sends a negative command so that the traffic signal 30 remains in a "Stop" condition. The vehicle is then required to stop and pay a toll in coin or token to obtain a green light.

The computer controller 22 also records date and time-of-use information, together with a predetermined user fee. This information is used, either by the computer controller or by a separate billing computer, to bill a cellular telephone subscriber whose telephone number corresponds to the ESN.

The command sent by the computer controller alternatively is used to control a visual signal at the restricted-access facility. Where an operator is used to monitor entrance to such a facility, the visual signal indicates whether the identification number of the vehicle desiring entry is on the list of valid user numbers. The visual signal may be a simple "Yes" or "No" indicator, or it may also display other information for use by the operator. The operator then decides whether to admit the vehicle to the restricted facility.

The operation of the system to control access to gated areas such as parking garages is very similar to the above description. A central computer controller monitors access to a number of garages over a wide area, requiring only that the access points be linked by a communications link as are the toll booths in the description above. An alternate embodiment uses simplified, local computer controllers at the site of the gate, or controlling a smaller number of entrance points in a limited area. These local controllers are remotely programmable, so that the list of valid ESNs may be updated from a remote terminal once the proper security codes are entered.

The embodiments shown and described above are only exemplary. I do not claim to have invented all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A method for automatically detecting and identifying vehicles having cellular telephone equipment, comprising the following steps:

a) receiving a cellular-frequency signal from a vehicle to detect an approach of said vehicle to a restricted-access facility, said restricted-access facility including a toll-road booth, and said signal being received by an antenna having a restricted zone of transmission and reception, b) receiving said signal by an antenna in which said restricted zone of reception is further limited by a downward orientation of said antenna, so that reception by said antenna is restricted to an area proximate said antenna, c) transmitting a query to the cellular telephone equipment aboard the vehicle, said vehicle being within a vehicle identification zone, d) transmitting responsive to said query an identification number from said cellular telephone equipment, e) receiving said identification number by said antenna, including said identification number transmitted responsive to a command entered by a user of said cellular telephone equipment, f) transmitting said identification number to a computer controller, g) repeating, responsive to a request by said computer controller, a transmission of said identification number from a short-term memory to said computer controller, h) processing said identification number within the computer controller to determine whether said identification number matches a number on a list of j) valid identification numbers, transmitting a traffic-control command from the computer controller to said restricted-access facility, k) activating by said traffic-control command a traffic control signal for a traffic lane through said restricted-access facility, l) activating by said traffic-control command a visual signal for use by an operator of said restricted-access facility, m) recording a predetermined user fee together with date and time-of-use information, and p) billing said user fee to a cellular telephone subscriber whose telephone number corresponds to said identification number.

* * * * *